US007720435B2

(12) United States Patent
Bettinger

(10) Patent No.: US 7,720,435 B2
(45) Date of Patent: May 18, 2010

(54) MULTICAST RECEPTION MEASUREMENT SYSTEM

(76) Inventor: David S. Bettinger, 8030 Coventry, Grosse Ile, MI (US) 48138

( * ) Notice: Subject to any disclaimer, the term of this patent is extended or adjusted under 35 U.S.C. 154(b) by 776 days.

(21) Appl. No.: 11/557,826

(22) Filed: Nov. 8, 2006

(65) Prior Publication Data

US 2008/0108297 A1 May 8, 2008

(51) Int. Cl.
*H04H 20/74* (2008.01)

(52) U.S. Cl. ..... 455/3.02; 455/3.03; 455/13.2; 455/503; 370/520

(58) Field of Classification Search ..... 455/3.02, 455/3.03, 13.2, 61, 208, 502, 503; 370/208, 370/487, 520, 529; 375/260; 342/356, 464
See application file for complete search history.

(56) References Cited

U.S. PATENT DOCUMENTS 6,845,230 B2 * 1/2005 Syed ..... 455/3.02

* cited by examiner

*Primary Examiner*—Matthew D Anderson
*Assistant Examiner*—Shaima Q Aminzay

(57) ABSTRACT

A business model of satellite digital audio broadcasting, also referred to as multicasting, teaches computer improvements in business operations for the determination of the number of listeners and listeners' preferences of multicast satellite transmissions and more particularly to the detection of signals from a multitude of individual client radios that simultaneously respond to a polling signal with a radio frequency chirp. A response to a polling signal instruction is synchronized utilizing an instruction embedded within a digital audio broadcast. Further embodiments teach a determination of listener count derived from signal strength, single chirp signal strength contribution derived from reception delay, and media prioritization derived from changes in user preferences.

12 Claims, 5 Drawing Sheets

| (1) Measured Signal Strength mV/m$^2$ | (2) Measured Reception Delay Sec/(000) | (3) Calc. Distance miles | (4) Calc. Unit Signal Strength mV/m$^2$ | (5) Calc. Estimated Count # |
|---|---|---|---|---|
| 23.061 | 0.002 | 0.36 | 0.579 | 40 |
| 17.296 | 0.004 | 0.72 | 0.145 | 120 |
| 12.812 | 0.006 | 1.08 | 0.064 | 199 |
| 10.089 | 0.008 | 1.44 | 0.036 | 279 |
| 8.302 | 0.010 | 1.80 | 0.023 | 359 |
| 7.047 | 0.012 | 2.16 | 0.016 | 438 |
| 6.118 | 0.014 | 2.52 | 0.012 | 518 |
| 5.405 | 0.016 | 2.88 | 0.009 | 598 |
| 4.840 | 0.018 | 3.24 | 0.007 | 677 |
| 4.382 | 0.020 | 3.60 | 0.006 | 757 |
| | | | **Total >** | **3985** |

MULTICAST RECEPTION MEASUREMENT SYSTEM

This invention is related to computer improvements in business operations for the determination of the number of listeners and listeners' preferences of multicast satellite transmissions and more particularly to the detection of signals from a multitude of individual client radios that simultaneously respond to a polling signal with a radio frequency (RF) chirp.

The business model of current satellite digital audio broadcasting (DAB), also referred to as multicasting, is based on subscriber payments with a minimum of advertisements. The audience for satellite radio is considered a premium group with more per capita buying power than the audience for free broadcast radio. Advertisers generally pay a premium to reach this group in general and a further levy to reach specific segments due to the capability of digital satellite multicast to direct messages at specific channels that are demographically or lifestyle related to the product or service. For example, listeners of classical music may be more inclined toward the purchase of an expensive car. Currently it is not possible to determine any direct measure of the total number of listeners in real time to a specific channel of an audio media broadcast on either satellite radio or free broadcast radio. Many schemes to estimate the number of listeners extrapolate a relatively small representative sample of listeners to an approximation of the total. Some current listener statistics come from partial consumer surveys, market segmentation data from the service agreement form, or the radio equipment warranty return card. Embodiments of the present invention provide counts of listeners to a specific multicast channel based on a poll of listener's client radios and make the information directly available to the broadcast management.

The embodiments of the current invention teach that a statistically significant count of the number of listeners to a specific DAB advertisement can be provided to the multicast organizational management for an entire continent, and therefore provided, through their billing practices, to the advertiser in real time for immediate payment.

Within wireless communication there are many methods for counting transmitter stations if each station occupies a separate frequency and if each station possesses a signal strength adequate to independently reach the counting monitor. Embodiments of the present invention provide a statistically significant count of independent transmitters when all stations transmit at the same frequency and no station has the signal strength to alone reach the monitor from the extant of the monitoring area.

One possible alternative to the teachings of this invention would be to utilize cell phone communication in response to a polling signal. Many vehicles are purchased with both DAB client receivers and cellular connections built in to the common electrical platform. However, desktop client radios have no such common platform and would be omitted from a total representation of a relevant statistical survey of all users in real time. In addition, the use of embedded cell phones for polling response is likely to create cellular overload in many locals. Further, the tolling and counting of millions of extremely short cellular calls would likely be problematic.

BRIEF DESCRIPTION

Briefly stated, embodiments of the current invention teach a client radio, which comprises a client satellite radio audio multicast receiver connected by internal circuitry to a client responder. The client responder comprises a chirp transmitter to provide for the client radio generating a chirp transmission simultaneous with any other client receivers that are tuned and receiving a common multicast channel in response to a polling signal from a satellite transmitter. A novelty of these embodiments of the current invention resides in a client digital audio broadcast (DAB) radio that receives an instruction as a line of digital code, in this case a polling signal, within a DAB and synchronizes a response by utilizing the bit rate of the digital transmission according to the DAB polling signal instruction. A novelty of these embodiments of the current invention resides in the use of a pause circuit to synchronize elements in the significantly retarded audio media of DAB. DAB is a media that is recognized to be only approximate as a time-telling mechanism because of its 5 to 20 second delay of a studio announcement of the exact time, compared to an external clock time such as Greenwich Mean Time. Thus, independent elements are put in unique synchronization in spite of instructions being received via the DAB.

Briefly stated, embodiments of the current invention teach a multicast audience measurement system comprising a remote transmission source selected to provide digital audio multicasts and synchronizing polling signals for at least one digital audio broadcast (DAB) local area. The digital audio multicasts and the synchronizing polling signals are received by a multiplicity of the client radios. Each client radio comprises a receiver and chirp transmitter. Each receiver and chirp transmitter is disposed to receive and process DAB signals for consumer selected multicast audio media delivery. Each receiver and chirp transmitter is disposed to receive, process, and issue the synchronizing polling signals to provide for responsive RF signal transmission chirps for each client radio, at a known reception signal strength, in simultaneous concert with other client radio receivers and chirp transmitters within the DAB local area. The responsive RF signal transmission chirps are received by a local monitoring station within the at least one DAB local area. The local monitoring station is independent and distinct from all transmission-reception DAB communication pathways. The local monitoring station comprises a communicator, the communicator being engaged in continuous data transfer of client counts related to polling signals that are communicated to a data collection site. The local monitoring station is selected to receive, process, and measure indicated signal strength of the short RF transmission response chirp and to detect and measure the total signal strength of the received multiplicity of RF signals. A statistical representation of the total number of the client radio receivers and chirp transmitters is derived directly from the obtained total signal strength data of a multiplicity of RF chirp signals that are to each other valued at a known approximated signal strength. A novelty of the embodiments of the present invention resides in the determination of a listener count that is derived from the total strength of all the RF signals divided by the signal strength of one RF signal.

Electronic generation of chirps within radio frequencies are well documented and widely used in industry. Various approaches to electronic circuitry have been explored to assure a rapid rise and fall off of the electronic signal and precise generation to assure proper interpretation upon reception. Such chirps have been used for switching instruction, circuit testing, direction finding, radar applications, radio frequency identification, and positioning. An independent ground based local monitoring station accomplishes the monitoring of the chirp transmitters. This concept combined with the fact that the polling signal source is in orbit creates a single unidirectional flow path of data and a count of listeners. A novelty of the embodiments of the present invention resides in both the orbiting polling source and ground based local monitoring station are independent of each other. The total signal strength of the sum of all transmission chirps is measured locally by the local monitoring station (LMS). Embodiments of this current invention teach that the polling signal transmission from a remote source orbiting satellite is simultaneous with the client radio alert to simultaneously transmit to the LMS, which monitors from a ground site local to the client radio. A novelty of the embodiments of the present invention resides in simultaneity of the remote orbiting satellite source polling signal with the client radio alert to simultaneously transmit to the LMS. Thus, a unique dual simultaneous synchronization is created from one polling signal. Embodiments of this current invention teach a system which provides for polling of a total audience with the distinction that the polling may be selected to take place simultaneously with the audio presentation of an audio advertisement. A response is elicited from only those client radios tuned to that particular advertisement with the volume at an audible level, thus providing a real time count for billing of the advertiser on a per listener basis.

The chirp signal strength serves as a direct comparative measure of the count of receivers tuned to a specific channel within a local area. The data from a multitude of local areas is transmitted by the LMS to a master location by either land phone, cellular phone, internet, or direct satellite link continuously of intermittent length for interpretation and integration into a total audience measure in real time.

These embodiments of the current invention also teach that the intervals of delay in reception from segments or groups of a multitude of simultaneous equal transmissions is a direct instantaneous indicator of the signal strength as received by a local monitoring station of the contribution of each individual contributor transmitter. Thus, it is also a direct instantaneous indicator of the number of contributing transmitters within the time segments. The method of remote synchronized local channel reception summation provides for audience market share determination by signal strength segmentation.

Briefly stated, embodiments of the current invention teach a time-interval group calculation method for the determination of the total number of a multiplicity of simultaneously generated, individually undetectable short RF transmission chirps. These RF transmission chirps are disposed with a known transmitted signal strength and received by the local monitoring station.

A novelty of the embodiments of the current invention resides in a common timed reception delay, primarily due to distance, of a group of simultaneous and equally individually undetectable burst chirp signals. This reception delay permits one to derive, estimate, and approximate the signal strength contribution of each signal, and therefore the number of burst signals within the total signal strength measure. This is based on the observation that chirp transmitters at the same approximate distance would enjoy approximate synchronicity of reception at a single receiver. This is also based on the understanding that a multitude of individually undetectable transmissions each make a contribution to the broadcast energy within the radio medium that is detectable when the transmissions are commonly tuned to the same radio band within the radio spectrum.

DESCRIPTION OF THE EMBODIMENTS

An embodiment of the present invention is a client radio that comprises a client DAB receiver and a client responder. The client DAB receiver is disposed to receive a polling signal from a remote DAB transmitter, which is connected by internal circuitry to a client responder. The client responder provides for detection and clocking of a digital audio broadcast (DAB) bit rate, and further provides interpretation of digital information within the polling signal received from the remote DAB transmitter. It is disposed to receive a timing instruction coupled with a paused alert. The paused alert is disposed for on a basis of the timing instruction and the DAB bit rate. For the purposes of the embodiments of the present invention, an instruction is a form of communicated information that is both command and explanation for how an action, behavior, method, or task is to be begun, completed, conducted, or executed.

Further the responder comprises a chirp transmitter which is configured to provide for issuance a predetermined RF signal strength chirp. Further, the client radio chirp issuance is disposed for synchronicity with a multiplicity of other equivalent client radio chirp issuances within a local DAB area. Further, the synchronicity disposition is provided for by the client radio synchronization response utilization of the digital audio broadcast (DAB) transmission bit rate. Whereby, instance of alert communication issuance to the chirp transmitter is determined by utilization of the digital audio broadcast (DAB) embedded chirp timing instruction.

Client radio receivers accepting digital audio broadcasts (DAB) use proprietary circuitry to receive, decode, and demodulate DAB signals and convert them into an audible media stream. DAB can carry many audio services on a single frequency. The utilization of DAB requires specific radios to be purchased in order to receive a specific satellite DAB supplier's service. Because of the technical linkage between the specialized client receivers and the DAB service provider, further proprietary circuitry for signal transmission can be added to these client radio receivers as an upgrade. Embodiments of the current invention teach that a chirp transmitter and supporting circuitry is added within the client receiver or as an external retrofit accessory for the client radio responder to issue a chirp response when queried by a polling signal embedded in the DAB. In FIG. 4 and the detailed description of FIG. 4 a block schematic of the client DAB radio and the client responder is described.

For the purposes of the embodiments of the current invention a polling signal is defined as the set of digital instructions transmitted as a portion of DAB that provide synchronicity and a series of queries. These queries are the basis upon which an individual client radio receiver automatically determines as to whether or not to respond with a chirp issuance. The queries may comprise specificity as to fixed or mobile installations, channel tuned, volume level, and the amount of time to be allocated to the preset pause before onset of the simultaneous transmission of chirps with all similarly instructed client radios. Since DAB already includes mechanisms, software, and hardware systems for the inclusion, sequencing, and queuing of both audio media and text media segments as well as for the generation and communication of instructions for control of the satellite broadcast capability the inclusion of a polling signal is easily accommodated.

For the purposes of the embodiments of the current invention, the digital audio broadcast (DAB) bit rate is defined to be the same as the current industry US standard of 128 K-bits/sec. For the purposes of the embodiments of the current invention, the digital audio broadcast (DAB) embedded chirp timing instruction is defined to be a preselected interval of timed pause, for example, 10 milliseconds. Alternatively, the embedded chirp timing instruction is defined to be an interval of timed pause calculated by an internal hardware, firmware, or software algorithm to direct the issuance of simultaneous chirps at an instance compatible with other aspects of the DAB, such as a null period between DAB media packets.

For the purposes of the embodiments of the current invention, an RF transmission chirp is a short radio frequency burst of low signal strength in the range below 10 mV/m$^2$. The chirp may express itself as an analog or digital signal in the same bandwidth as the DAB. The low signal strength assures non-interference with other RF sources but may in most cases be insufficient to be individually detectable by a local monitoring station (LMS). The low signal strength also means that an inexpensive chirp generator can be employed that will display a distinct and rapid rise and fall off of the signal generated. The ideal duration of a chirp would be the time-interval used for segregating groups by their distance from the LMS. It is the summation of multiple near simultaneous bursts that add to make a measurable and comparable statistical estimate of the total burst count. If the chirp uses the same band as the DAB, then the chirp is scheduled within the media band at a null broadcast time of two to ten bits at the normal DAB rate of 128 k-bits per second, after the onset of the chirp monitoring period which is simultaneous with all chirps. The chirp does not imitate the polling signal from the satellite as a transponder. The chirp is a responder signal.

Another embodiment of the present invention is a multicast audience measurement system comprising a) a remote transmission source selected to provide digital audio multicasts and synchronizing polling signals for at least one digital audio broadcast (DAB) local area. The digital audio multicasts and the synchronizing polling signals received by, b) a multiplicity of the client radios, each client radio comprising a receiver and chirp transmitter. Further each receiver and chirp transmitter is disposed to receive and process DAB signals for consumer selected multicast audio media delivery. Further, each receiver and chirp transmitter is disposed to receive, process, and issue the synchronizing polling signals to provide for responsive RF signal transmission chirps for each client radio, at a known reception signal strength ($S_N$), in simultaneous concert with the other client radio receiver and chirp transmitters within the DAB local area. Further the responsive RF signal transmission chirps are received by, c) a local monitoring station within the at least one DAB local area, the local monitoring station independent and distinct from all transmission-reception DAB communication pathways. Further, the local monitoring station comprises a communicator that is in continuous data transfer of client counts to a data collection site related to polling signal instructions. Further, the local monitoring station is selected to receive, process, and measure indicated signal strength of the short RF transmission response chirps. Further, the local monitoring station is selected to detect and measure the total signal strength of the received multiplicity of RF signals ($S_T$).

Whereby, a statistical representation of the total number of the client radio receiver and chirp transmitters ($N_R$) is determined by the equation: $N_R=S_T/S_N$.

One embodiment of a satellite digital audio broadcasting system after the teachings of the present invention is illustrated in the schematic of FIG. 1 and in the detailed description of FIG. 1. The positive attributes of DAB satellite subscription services for the client are media variety, audio quality, and channel selection independent of location. DAB is not affected by minor interferences but will degrade quickly when the signal quality is poor. The audio encoding used by most DAB implementations produces a sound that is not a true reproduction of the original but is perceived to sound the same by the human ear. For the purposes of the embodiments of the current invention, satellite radio is the primary DAB provider. However, the current invention applies equally to terrestrial tower based DAB. Satellite radio currently uses the 2.3 GHz S band in North America and in some locations shares the 1.4 GHz L band with local DAB stations. The signal is received directly by a client subscriber because the direct, energetic broadcast satellite signal that client receivers accept require no ground based dish for reception. Only three satellites are sufficient to provide coverage for an entire continent. Each satellite company uses different algorithms for audio data compression, different modulation techniques, different methods for encryption and conditional access. For purposes of explanation for the embodiments of the current invention, these differences in algorithms, modulation, and encryption have been simplified to present the broadcast as distinct packets that are expanded to streaming audio. Streaming media is media that is divided into transmitted segments or packets that when received are saved and indexed in the correct sequence and reconnected into a seamless but electronically delayed presentation from the original studio media.

Common to most radio services, beyond the audio media itself, satellite radio transmits program-associated data (PAD or metadata), describing the artist, program title, and channel designation. Metadata is also a candidate for carrying the polling signal in some systems.

It is to the marketing advantage of DAB broadcasters to provide as many channels as possible squeezed into each DAB multiplex or multicast. This increases the number of audio media channels available but the resulting reduced bit rates erode audio fidelity. A bit rate level of 128 kbit/s is considered adequate. The teachings of the embodiments of the current invention state that within this generally compacted data stream there still exists room for the polling signal. This is due to the nature of the entire multiplexing process that must add both code and extraneous material in the process without perceptible change in the quality of the audio broadcast.

Embodiments of the present invention teach that a polling signal can be configured so as to poll varying client receiver communities for baseline comparison. This baseline comparative data can then be used for interpreting the results of polling for listeners to a particular channel at a particular instance. Six examples of client receiver communities are 1) all receivers that are currently turned on anywhere within the range of the satellite signal, 2) all receivers within the area of an LMS, 3) all receivers with the volume control at an audible level, 4) all receivers that are turned to a particular channel, 5) all stationary receivers, and 6) all mobile receivers. Baseline polling can also be useful for determining data that would support premium charges for advertising such as a clustered response. The ability to determine the preferences of a cluster of DBA subscribers in an up-scale demographic area would be valuable. Such clustered response is possible because the polling signal may contain a variety of instructions that apply to all or only one client receiver. An individual response is possible since each client receiver has a unique electronic serial number (ESN) that can be specified in a polling signal. When a unit is activated with a subscription, an authorization code is sent in the digital stream telling the receiver to allow access to the blocked channels. Most services have at least one "free to air" or "in the clear" (ITC) channel as a test. The basic information about a LMS comes from the registration of clients within a local area. These clients may be polled as a distinct group to determine their signal strength and chirp distribution. The use of directional receiver antennas with an LMS can further segregate client receiver responses within a LMS area. One embodiment of a local monitoring station (LMS) is illustrated in the schematic of FIG. 2 and in the detailed description of FIG. 2.

The embodiments of the current invention teach the need for null transmission by the DAB satellite of up to ten bits at 128 k-bits/sec to provide bandwidth silence during the period of the chirps' responding, lest the chirps interfere with audio media in the multicast. The frequency of the polling signals is based on the need for listener data. Every advertisement may include a single polling signal for billing purposes. Mobile clients may be polled only two or three times an hour during the period when most are driving to work. Late night listeners may only be polled for listening preferences once during an evening. Although the counts of responders to a specific polling signal are available in real time, the polling is not continuous but rather periodic based upon the need for updated listener data. This limited and periodic pace of polling is an indicator that these silent null periods in the DAB multicast spectrum are an undetectable burden to the audio listener.

For the purposes of the embodiments of the current invention, the local monitoring station (LMS) is a system element independent of the current DAB system. One embodiment of the LMS is illustrated in the block diagram of FIG. 5 and in the detailed description of FIG. 5. The LMS comprises a receiver incorporating one or more antennas for receiving chirps, a pause interval circuit, a signal strength detector, an analysis circuit incorporating electronic measuring and interpretation circuitry and/or software/firmware, and a communicator. The communicator is in generally continuous data transfer of client counts related to the particular polling signal instruction to a data collection site by either land line, cellular, internet, dedicated network, or wireless transmission. One embodiment of the arrangement of components and how they integrate with and within a DAB system is illustrated in the FIG. 3 flow diagram and in the detailed description of FIG. 3. Other local areas also communicate the count in their areas related to the particular instruction embedded in the polling signal. Thus a total count is generated and summed for a statistically significant measure of all the client receivers for the DAB satellite transmission. All satellites transmitting the same polling instructions to other continental areas may report to the same collection site for summation into a measure related to the total DAB preferences in audio listening material for an entire continent in real time. In like manner an audio advertisement may contain a polling signal. Since a local area covers a known population with known zip codes and known demographics, the result of polling an advertisement under the teaching of the embodiments of this invention can provide valuable consumer and lifestyle information as a justification for premium billing to the advertiser by the DAB service provider.

A DAB satellite system only requires three orbiting satellites to cover a continent. According to the teaching of the embodiments of this current invention a multitude of towers will be required to monitor each area of coverage by a single satellite. Fortunately, the cellular networks have built and leased sufficient elevated locations on sites with built-in communication capabilities that are commercially available for this enterprise. Thus, embodiments of the present invention have the likely opportunity within the present cellular network industry to efficiently utilize both existing tower structures and existing cellular communication networks to advantage. In telecommunication practice and for the purposes of the embodiments of this current invention, signal strength is the measure of how strongly a transmitted signal is being received, measured, or predicted, at a reference point that is a significant distance from the transmitting antenna. A typical measure of signal strength is as signal voltage per square area or signal power received by a reference antenna. Higher-powered transmissions, such as broadcasting, use units of dB-millivolts per square meter (dBmV/m$^2$). Very low-power uses such as mobile phones are most often expressed in dB-microvolts per square meter (dBμV/m$^2$) which represents the number of decibels below a reference level of one milliwatt (eg −80 dBm). In broadcasting terminology 1 mV/m$^2$ is 0 dBm (a shortened dB(mV/m$^2$)), or 60 dBμ (often written dBu) and has no reference to the dB milliwatt, the more common use of dBm. Examples of three common reception scenarios and the relative measures are 100 dBμ or 100 mV/m$^2$ when blanketing interference occurs, 60 dBμ or 1 mV/m$^2$ occurring at the edge of a radio station's protected area, and 40 dBμ or 100 μV/m$^2$ representing the minimum strength a station can be received.

Adjustments to the raw as-measured signal strength by the LMS may be necessary due to signal proximity. A multiplicity of simultaneous chirps arrives at a scattering of times at a LMS receiver due to distance, attenuation, and other factors. The signal strength of one chirp must be strong enough to contribute to the measurement estimate and be weak enough not to sway the count if too close to the LMS, or too strong in mass to create interference with other wireless media. For this reason chirps that are received immediately after their due instance of onset are deemed by the interpreter in the LMS to be so close in proximity that their signal strength may need to be adjusted in the total count by a factor in addition to distance.

The embodiments of the current invention teach that the total count within a local area is a direct representation of the total within statistical bounds but is not an absolute count. There are at least five reasons why some chirps from client radios may not register with the LMS receiver. First, transmitted chirps close to the LMS receiver do not follow the inverse square of the distance rule. Within the circle of the local area of a rural LMS, there will likely be few client radios that will be falsely valued. However, in urban areas the error due to close proximity to the LMS may require correction factors applied to the calculation either in the LMS software or firmware. Second, although distance is the predominate reason for received chirp delay there are other factors such as radio propagation conditions, the local geography, and the influence of hills, large buildings and metallic reflective structures such as bridges, warehouses etc. However, DAB was set up with standards to minimize multipath interference or fading which may prove to benefit the accuracy of the responders under the teachings of the embodiments of the current invention. Third, there may be too few client radios in any one time-interval group to overcome the threshold of background broadcast noise. For the purposes of the embodiments of the present invention, a time-interval group refers to those chirp signals that arrive at the LMS receiver within a predetermined segment of time. For example, a group of chirp signals arriving at a receiver at about the same time in a timed cluster at approximately one-hundred thousandths of a second delay after simultaneous chirp issuance would represent client radios at approximately 1.9 miles away. Fourth, some rural areas are unlikely ever to be monitored since the cost of erecting a tower is too high for only a few cellular and satellite radio customers. Fifth, even in high reception areas where each chirp is strong, chirps from client radios in basements and the interiors of large buildings may be absorbed with the result that its contribution to signal strength will be lost.

If the initial preset response delay within all client radios is the same interval, then all client radios will chirp at the same instant. However, the LMS will not receive all the chirp responses simultaneously. The arrival of the chirp responses at the LMS will be effected by the distance from the LMS, in addition to other factors.

Many satellite radios are mounted in vehicles and their chirps may suffer from positional degradation as they move, necessitating a correction to their chirp delay lest their signal strength contribution be lost. In one embodiment of the current invention the LMS is equipped with an area signal transmitter and the initial chirp delay is preset in the reception detection circuit of all client radios to the same interval.

For the purposes of this invention a local area is that territory, tract, or portion of topography that is selected to provide adequate reception of contributing chirps for at least one receiver from the periphery of that territory. Where buildings and obstacles limit satellite reception, chirp reception is also generally limited. That joint limitation on area means that some local areas may be generally synonymous in area with a ground-based repeater of a satellite multicast. A local area is a small subset of the vast portions of a continent that is covered by the multicast of a single satellite. Multiple directional LMS antennas may be mounted on a common tower or base to provide further demographic discrimination between adjacent listener areas. For example, there are many areas where the wealthy reside next to the less affluent. Separation of the listener preferences between such areas can be useful for DAB programming, billing, and marketing purposes.

A graph of signal strength for uniformly distributed clients over a generally circular area may show a nearly uniform level during a polling cycle when the LMS is generally in the center of the local area. This leveling occurs because of the two balancing effects, the further from the center the weaker the signal, but the further from the center the more chirps contribute to the signal. A graph of the count of the number of client radios responding tends to be a generally flat curve with a sharp entry and fall-off for a large number of clients.

The LMS transmits a strong signal at a preset interval after the maximum indicated signal strength peak, indicating the interval after the polling signal at which the LMS received the majority of the chirps. If that LMS strong signal indicates to the consumer radios that its signal was received early due to the close proximity of the LMS, then the consumer radios will retard their chirp response intervals by half the lateness. If the LMS signal strength indicates to the consumer radios that its signal was received late, if at all, then the consumer radios will shorten their chirp response intervals by half the lateness to peak interval. In the detailed description of FIGS. 7*a-e* and in the series of curve and bar diagrams in FIGS. 7*a-e* themselves, the relationship between the arrival of the chirp responses at the LMS and the effect of the chirp transmitter distance from the LMS is discussed.

In the context of the embodiments of the present invention, statistically significant means an audience measure with a confidence level of 80% or better when the number of listeners exceeds a threshold, such as 50 listeners for a given channel within a local area. A threshold is indicated since fewer chirps may be insufficient to generate enough EMF to register at an LMS receiver. The threshold may be small for a LMS covering a large LMS area with few client radios.

Various embodiments of the current invention are described using simplified diagrams illustrating transmissions divided into packets in order to explain components, operation and usability within a DAB system. The actual provision of a DAB satellite service is much more complex than this packet illustration and utilizes coding practices and circuitry such as Coded Orthogonal Frequency Division Multiplexing. The following description serves to illustrate that complex polling instructions can be embedded in DAB transmissions and successfully decoded by client radios since the complex DAB process is electronically automated with inherent data flexibility and capability. Original audio media carried over the multiplex is changed by splitting it into small blocks. Redundant data is added to each block. This redundant data reduces the data density and is referred to as overhead. Rules dictate how the overhead bits are added to each block. Upon reception and demodulation the digital signal processor examines both the actual data received and overhead bits in order to regenerate a simulation of the original data based on an algorithm. The regenerated data may include data bit corrections based on history and likelihood. The overhead of this coding requires increased channel capacity and bandwidth.

Another complication of DAB operations is bandwidth use. Orthogonality is the geometric term applied to two RF sinusoidal signals when they are 90 degrees out of phase, also referred to as being in quadrature. In DAB the sub-carrier frequency spacing is chosen to be the reciprocal of the active symbol period. This causes successive sub-carriers to possess a quadrature relationship. The frequency spectra components of one modulated sub-carrier will therefore sum to zero from both adjacent sub-carriers. Thus, the modulated sub-carrier can use much of the allocated bandwidth and the demodulation approach eliminates the need for multiple bandpass filters to extract the sub-carriers.

A further complication of DAB operations is frequency division multiplexing (FDM). FDM allows two or more data bandwidths or basebands to be shifted in frequency and added to others forming a combined and wider bandwidth containing data from all of the component basebands.

A still further complication is that DAB uses a digital modulation type known as differential quadrature phase shift keying (DQPSK) which is an incoherent modulation scheme. DQPSK differs from the more common quadrature phase shift keying (QPSK) in that the modulated carrier phase for the current symbol being detected depends on its phase relative to that phase detected for the previous one. For QPSK it is just the absolute phase of the modulated carrier that determines the associated symbol. A differential modulation scheme can be more resilient to the typical fading scenarios of DAB. The modulation scheme also incorporates a form of Gray coding in that only one bit changes on moving from one symbol state to an adjacent one. For a constant phase progression, the consecutive set of symbols is represented by the bit pairs 00, 01, 11, and 10.

A still further complication is that DAB uses data buffering. This enables the data symbols to be transmitted over the RF path in a different time-order than they were generated with the audio data was created. The receiver re-assembles and returns the original time-order before conversion back to analog signals to feed the receiver audio output in a time interleaving process. This interleaving process is similar to the packet process used in the explanation of various embodiments of the current invention. A positive attribute of interleaving is that the typical multipath interference experienced in a moving vehicle is regular over time so interleaving moderates the resulting error gaps over time. A result of data buffering and other processing is a delay, typically of a few seconds, between a live studio audio source and the receiver. This is much longer than the equivalent time lag of a FM broadcast channel that would typically be a fraction of a second. For most broadcasts such a time lag is secondary except when a reference is made to the exact time such as Greenwich Mean Time.

DAB also uses frequency interleaving, a similar technique to time interleaving but applied to the sub-carriers' center frequencies in the RF spectrum instead. The data stream from the studio is deliberately not modulated serially onto sub-carriers across the frequency range, but instead in a more random way. Multipath and other forms of selective fading generally affect a relatively narrow part of the RF multiplex bandwidth at any one time so frequency interleaving would tend to average out 'bursts' of errors resulting from these.

A major attribute of DAB is the provision of single frequency networks (SFNs). Provided the transmitters are synchronised, the multiplex licence holder may operate several in a relatively small geographic area at the same multiplex frequency without any destructive interference occurring at the receiver. SFNs allow substantial service areas to be built up steadily and efficiently as the network develops, as funding allows and as frequency spectra becomes available. A typical DAB network will comprise several relatively low powered closely spaced transmitters operating at the same multiplex frequency. This saves frequency spectrum, reduces the complexity and cost of the transmitter hardware and avoids the need for frequent re-tuning of mobile receivers as they move about within the network. It also means that each transmitter has a smaller audience, thus mitigating the service loss should a transmitter fail. Because of this synchronisation, receivers which are located in places where the service areas of two or more transmitters overlap will interpret one of the signals as a slightly delayed version of the other, effectively an apparent deliberate multipath interference. The actual delays will depend on the radio path geometry and any extra delays that may be added artificially when the network is commissioned. Within the receiver then a relatively simple form of filtering may be applied to extract the desired data.

All of the DAB coding processes taken together mean that a real audio input to a satellite transmission may emerge after a distinct time lag from a DAB client audio speaker or headphone output. This has profound effects for synchronizing signals that are independent of the internal DAB coding circuitry. First, it means that an immediate chirp response to a polling signal is very likely to overlay DAB media or data. Second, the synchronization of a null signal in the satellite broadcast to accommodate the simultaneous chirps must be scheduled with distinct starting and stopping instructions to avoid misinterpretation by some step in the decoding process. These two and other considerations create the need for a pause circuit within the client radio to avoid interference and the loss of chirp synchronization. A similar pause circuit must then be included in the local monitoring station to be in synchronization to begin signal strength delay measurements simultaneous with the chirps of all client radios in the local area. Without the LMS being instructed as to the exact onset micro-second, ongoing reception of chirp signal strength versus time would have no initialization point to determine distance and thence unit signal strength of chirps at that distance. Thus, no representative count of responding client radios would be possible.

In FIG. 10 and the detailed description of FIG. 10 illustrate a numerical representation of the LMS internal process that leads to a total count of responders within a local area.

One embodiment of the current invention teaches that a common timed delay in reception of a group of simultaneous and equally individually undetectable burst chirp signals is used to derive the number of burst signals within the total signal strength measure. This is illustrated in the table of FIG. 8 and in the detailed description of FIG. 8.

For example, a particular satellite DAB company has implemented a listener monitoring and reporting system (LMRS) to determine listener preferences and a representative approximation of the total number of listeners using DAB client radios to any particular advertisement. The company multicasts 105 audio media channels at a fixed DAB bit rate of 128 K-bits per second utilizing demodulation, re-sequencing, and coding (DRC) techniques common to the DAB industry. For many popular channels the company airs thirty-second audio spot advertisements at a rate of twelve per hour. To implement the LMRS the company through its broadcast control studio, using its communication uplink to the broadcast satellite, has added a polling signal to their DAB multicast. A first portion of this polling signal comprises the specification of a pause interval for the purpose of synchronization of the onset of response generation. This is a preselected synchronizing onset time instance for all groups. This pause is selected to be common with a null period of multicast broadcasts. In addition this pause is specified as an integer after DRC, thus indicating a specific number of bits to be counted as a waiting duration or pause after reception, in this case 12. A second portion of this polling signal is at least one query that, after DRC, requests the status of the media channel tuner selection. Further included queries may specify other client radio control selections. In this case the query elicits a response if a particular client radio is tuned to media channel 32 with the volume level adjusted by the user to an audible level above zero. The point of interest in this channel is that an advertisement is being aired on that channel generally simultaneous with the polling signal. The listener count estimate based on the total client radio response will be used in determining the cost to the advertiser to be paid to the satellite company.

For the local implementation of the LMRS, the satellite DAB company has erected a local monitoring station (LMS) at a suitable height on a tower located generally central to a large suburban area with a coverage of an approximate area of 75 square miles. This LMS station is equipped to continuously monitor the DAB for an incoming polling signal with embedded instructions as to when to begin monitoring. This initiation of monitoring is termed onset. The local area is irregular due to various buildings and hills and reaches out at the further extent to about six miles from the LMS. This six miles is an indication that a RF signal from the border of the local area will require about 32 millionths of a second to reach the LMS, this time interval being the duration of monitoring. This LMS is selected to receive short RF signals or chirps and measure the signal strength continuously and instantly during an active period of monitoring between onset and monitoring duration.

Within this local area, there are a multitude of client radios numbering in the thousands that are subscribers to the particular DAB multicast of the satellite company. All of these client radios are manufactured to respond to a polling signal with a short RF chirp of 1 mV/m2 at a known distance of one mile. Some of the subscribers' receiving equipment is fixed in location with the preponderance of the receiver equipment being mobile client radios within vehicles scattered at random across the local area. Programmed into the control software for the client radio is a default pause interval of 1/1,000 of a second but in this case the default is overridden by the polling signal specification of 12 bits pause. This pause of 94 millionths of a second is approximately one tenth of the default pause. This pause allows a brief null in the satellite broadcast signal to provide an open channel for broadcast and reception of a multitude of chirp responses from selected client radios. This null or dead-air duration has a duration of one ten-thousandth of a second which represents a substantial burden to the multicast system indicating that judicial and selective use of the polling signal is necessary.

The broadcast control studio has programmed the transmission from the satellite to include a query for channel number 32 out of 105 media channels that make up the multicast transmission. The pause interval that has been selected results in a synchronizing of all client radios that are tuned to channel 32. These client radios, based on their internal firmware, respond during the null broadcast period. Their response is a simultaneous chirp at onset. Because the thousands of responding client radio chirps are at varying distances from the local monitoring station, there are varying delays in their reception after onset based upon distances, and to a lesser degree, other factors such as obstructions and weather. Since the most distant of the client radios from the local monitoring station is less than 6 miles, a simple calculation using the speed of RF radio which is the same as the speed of light shows that the signal from that distant client radio will have a delay duration of about 32 millionths of a second. The six miles from the outlying client radio and the subsequent preselected programming of the LMS with this 32 millionth of a second maximum delay value is determined during installation of the LMS based on actual measurements due to the local topography and RF conditions.

Since the bit rate provides a timing mechanism of 7.8 millionths of a second, a division into four groups provides a convenient interval for segregating the signal strength measurement by the LMS of each of four groups. The LMS determines the single incremental time measure for the separation of all groups, in this case one bit. A single incremental time measure for the separation of all groups after onset is preselected. The LMS then proceeds to measure signal strength at the one, two, three, and four bit intervals beginning with the first signal strength measurement for each group after onset. The first signal strength measurement for each group after onset is made beginning with the first and taking subsequent sequential measurements, for each group, of peak signal strength during each time interval attributable to each time-interval group.

In this example the signal strength measurements are 21, 5.6, 4.1, 1.7 mV/m2 for the four groups respectively taken at 8, 16, 24, and 32 millionths of a second after onset which represents distances of 1.45, 2.91, 4.36, 5.81 miles respectively. This represents mathematically determining, for each group, cumulative time passage since onset and calculating distance that each time interval group is distant from the local monitoring station by utilizing the cumulative time passage for each group and by utilizing speed of radio transmission. Based on these numbers the calculated unit signal strength is 47, 12, 5, 3 mV/m2. This is mathematically determining an estimate of the received signal strength utilizing the distances for each group and utilizing the relationship that signal strength decreases as the square of the distance and calculating an estimate of each groups' received signal strength utilizing the cumulative time passage for each group since onset. These unit numbers yield a calculated estimate of the number of client radios audibly tuned to channel 32 for each of the four groups numbering 451, 478, 783, 589 client radios. Thus the number of chirps for each group is gained by dividing the peak signal strength by the received signal strength. The total number of chirps in all groups is summarized by adding the calculated number of chirps in all groups together. This summary of the total response to the polling for audible channel 32 is 2301 client radios.

Thus the present invention is a method of time-interval group calculation for the total number of a multiplicity of simultaneously generated, individually undetectable short RF transmission chirps. The RF transmission chirps are disposed with a known signal strength within a local area and received by the local monitoring station. It will be understood by one of ordinary skill in the art that a known signal strength means an indicated RF power density value received from a specific distance.

It will be understood by one of ordinary skill in the art that a variety of mathematical statistical approaches may be applied to this method comprising signal strength average, mean, median, or peak measurements. It will also be understood by one of ordinary skill in the art that differences between urban or suburban areas compared to rural areas, or differences between flat topography compared to hilly topography, will substantially change the ranges of these numbers used in the sample calculations, but the method of analysis illustrated will not differ.

A still further embodiment of the present invention is the multicast audience measurement system, wherein the synchronizing polling signal is configured to provide for a multiplicity of instructions selected for measurement of at least one of the client DAB receivers. This embodiment of the current invention teaches how the synchronizing polling signal is configured with instructions for the determination of the channel within the multicast to which the client radio is tuned. In FIG. 5 and in the detailed description of FIG. 5, the illustrated functionally segregated components of a typical client receiver are used to elucidate this point. Since user preferences are input into the system control, this interconnection between system control and the interpreter of the client responder provides for the interpreter to register what audio media channel is activated.

Such instruction may also comprise queries concerning the audible level, the data channel selected, the GPS location range, and the graphic media selected for display.

In this embodiment of the current invention the polling signal is received by the chirp transmitter with a delay of less than two seconds. This apparent simultaneity is considered to be real time. For the purposes of this embodiment of the current invention, real time refers to the insignificant interval, as appearing to a human observer, between the signal arrival and the resulting initiating action, despite measurable electronic system and transmission delays of as much as thirty seconds.

A still further embodiment of the present invention is the multicast audience measurement system, wherein the polling signal contains a value that is interpreted as a preset interval or pause to be counted or timed after polling signal reception.

For example, a DAB multicast includes in a polling signal the digital request for an actionable response in 20 bits when the multicast is programmed to be silent. In order to be identified as a polling signal within the decoded, demodulated, re-sequenced data media, a unique identifier must be selected and standardized for a DAB company. When both the LMS and the affected client radios receive the polling signal identifier, it alerts the various registers within the electronics of both the client radios and all LMS. As these registers fill with the instructions and queries from within the polling signal, the pause register initiates a count of bits until the pause register is satisfied. FIG. 6 provides a schematic flow diagram of this activity. If all conditions of the query can be satisfied by matches between the registers and the client radio controller status then both the client radios and the LMS are in an instantly actionable state. This actionable state or onset for the client radio results in a positive response or chirp. FIG. 8 provides a schematic flow diagram of this activity. This actionable state or onset for the LMS results in the initiation of signal strength monitoring.

In this embodiment of the current invention the RF transmission response chirps are received by the LMS in real time.

A still further embodiment of the present invention is the multicast audience measurement system, wherein digital audio broadcast (DAB) signal wavelength is synchronously disposed with the RF transmission response chirp wavelength.

This embodiment of the current invention teaches how the response chirp may be on the same wavelength as the DAB audio signal. This seeming interference of two signals occupying the same bandwidth is easily avoided by the DAB interrupt multicast to create a null space in the broadcast spectrum of ten or twenty bits to accommodate the chirp responses from client radios.

Because the entire multicast system is based on the integration of multiple media streams with elaborate electronic mechanisms of modulation, de-sequencing, and coding, it follows that the polling signal can occupy the same bandwidth common to the multiple media streams.

A still further embodiment of the present invention is the multicast audience measurement system, wherein digital audio broadcast (DAB) signal wavelength is non-synchronously disposed with the RF transmission response chirp wavelength.

This embodiment of the current invention teaches how the response chirp may be on a different wavelength than the DAB audio signal. For example, a DAB satellite multicast may be required by subscriber demand to carry so many multiple media streams that there is no room for a null or dead air time within the DAB bandwidth. In this case the chirp responses would be forced to a secondary broadcast band.

A still further embodiment of the present invention is the multicast audience measurement system, wherein the measurement system comprises at least one local DAB multicast ground repeater to provide for transmission service.

This embodiment of the current invention teaches how the multicast audience measurement system may utilize ground repeaters to provide for better transmission service of the polling signal. Current DAB satellite transmission is augmented by ground transmission in many areas due to obstruction or topography. The use of ground transmissions opens up the opportunity for distinct and unique polling signals specifically tailored to the local area. For example, a city such as Denver with surrounding mountains may be in a shadow from satellite broadcast. The ground transmitter would normally be a repeater of the satellite broadcast. However, the ground transmitter for Denver would have the opportunity to incorporate customized advertisements promulgating local Denver businesses. Therefore this invention teaches that the polling signal from both individual and groups of ground DAB transmitters can incorporate polling signals unique and separate from the satellite DAB polling signal.

A still further embodiment of the present invention is the multicast audience measurement system, wherein a local monitoring station (LMS) receiver comprises at least one directional antenna, the at least one directional antenna selected to detect the signal strength of RF transmission response chirps.

This embodiment of the current invention teaches how the multicast audience measurement system LMS receiver may utilize at least one directional antenna to provide for the detection of RF transmission response chirps' signal strength in order to provide for better transmission service. For example, a mountain may provide an advantageous location for a LMS. Yet the mountain may provide a view and RF access to two distinct communities. This invention teaches that directional antennas may improve the monitoring and analysis of a local LMS by providing the capability to segregate responses from different client populations.

A still further embodiment of the present invention is the multicast audience measurement system, wherein the local monitoring station (LMS) communicator is engaged in communication means with the data collection site. The communication means are chosen from the means of landline phone connection, cellular phone connection, internet communication, dedicated network communication, and wireless transmission.

This embodiment of the current invention teaches how the multicast audience measurement system LMS communicator may engage in communication with the data collection site. The count of client responses from a single LMS constitutes a data summary condensed to a single number in response to a single polling signal, therefore a variety of communication means may be utilized rooted both on a practical and on an economic basis. For the purposes of the embodiments of the current invention, communication means are defined to include ground to satellite wireless, cellular wireless, microwave relay, fiber optic cable, ground telephone service, internet messaging, and dedicated area networks.

For this embodiment of the current invention, the local monitoring station (LMS) communicator is engaged in real time communication of the RF transmission chirp count with the data collection site. This real time communication supports the potential for real time billing of advertisers based on relevant total responses. Except for maintenance and diagnostics this communication need only be in one direction, that is from the LMS to the data collection site.

A still further embodiment of the present invention is the multicast audience measurement system, further comprising at least one digital data receiver, the at least one digital data receiver is in electronic communication with the local monitoring station. Further the at least one digital data receiver is in electronic communication with the DAB satellite transmitter. Whereby, the change in user preferences derived from subsequent counts of statistically relevant samples of chirp responses for a particular channel provide for the prioritization of the selection of digital data media, imbedded in a DAB data channel for reception by the at least one digital data receiver.

For example, prior responses received over many months have shown that 22% of listeners in a particular metropolitan area switch from entertainment channels to a news and traffic channel in preparation for the afternoon commute from work toward home. On a particular day that number jumps to 60%. This is an indicator to the DAB studio staff to provide additional traffic coverage. One way that additional coverage can be provided is by transmitting over the DAB data channel a graphic map of the metropolitan area showing reported traffic tie-ups and alternative routes. This is considered by the studio staff a reasonable use of bandwidth due to the abnormal change in listener habits measured against long established patterns as measured by signal strength measurement of chirp responses.

This embodiment of the present invention teaches the RF chirp response and signal strength measurement as an efficient method of determining a relevant total statistical measure of client channel and therefore media preferences. Further teaching illuminates that the independent data channel of DAB can be more efficiently used for customer requested data. The independent data channel is capable of broadcasting maps, traffic conditions, weather alerts, destination routing, and even e-mail internet services for both visual display and synthesized voice audio presentation by the use of auxiliary supporting equipment such as flat panel displays and speech synthesizers connected to the client radio. Because the broadcast data stream is limited, not every DAB client can be served with full digital data on a custom basis. However, after the teaching of this invention a statistical relevant analysis of all data requests can be determined from subsequent polling and a comparison analysis of changes in response. This analysis can then be used as a basis to optimize the limited independent data stream within the DAB multicast to serve the majority of common client data services required. For example, a traffic tie-up on a high volume turnpike would likely cause an unusual number of mobile client radios to select the DAB traffic channel for local traffic news. This high number of traffic channel selections, as measured by client radio responses in a single local area covered by a single LMS, is sufficient to prioritize the studio broadcast, via the independent data channel, of a local map for display within the vehicle, despite the burden that the general download of a graphic would have on the bandwidth.

A still further embodiment of the present invention is the multicast audience measurement system, wherein the synchronizing polling signal is configured to provide for a multiplicity of instructions selected for measurement of at least one said client DAB receiver and further the multiplicity of instructions is also selected to elicit a response based upon consumer media channel selection at time of the response.

This embodiment of the current invention teaches how the synchronizing polling signal is configured with a multiplicity of instructions for the determination of the channel within the multicast that the client radio is tuned to and this multiplicity of instructions is also selected to elicit a response based upon channel selection at the time of the response.

An example of this embodiment is the retrieval of market penetration data for a 30-second audio advertisement spot for a national restaurant chain that locates its facilities next to major highways. The advertisement is to be aired on DAB multicast channel #27 just prior to the noon meal during the five-day workweek. The order from the restaurant chain for this advertisement to the DAB broadcaster indicates that the advertiser will pay a fee for each mobile listener to the advertisement. Referring to the order, a technician using the program control computer at the DAB studio places the half minute of advertisement audio media in the multicast queue to be played at 11:50 for five weekdays on channel #27. Still referring to the order the technician inserts a polling signal into the queue to be aired during the 30 seconds the advertisement is playing at approximately 11:50:15 am. The information to program the polling signal is resident upon the order and has been specified by the restaurant chain. The polling signal is structured by a simple computer program that runs on the program control computer. Thus, the same equipment that sequences the audio media for multicast is utilized. Using the simple computer program the technician chooses mobile from a menu of mobile, fixed, or both, and chooses channel #27 from a second menu listing all the channels. The transmitted polling signal comprises a synchronizing index signal, a query specifying the requesting criterion that only mobile client radios respond, a further query criterion that only client radios tuned to media channel #27 respond, and a further query criterion that all client radios with audio controls at any audible level respond. Only those client radios that can satisfy all of the query criteria respond with a synchronized chirp. The signal strength of these chirps is measured at a multitude of LMS sites nationwide. The summation of LMS estimates of the total number of audible client radios tuned to channel #27 is sent from the LMSs to the master site. The master site uses these measures of total listener audience to electronically debit the advertiser's bank account in real time. The restaurant chain finds an increase in luncheon business due to the exposure and repeats the use of DAB advertising.

While specific embodiments of this invention have been shown and described, further modifications and improvements will occur to those skilled in the art. All modifications that retain the basic underlying principles disclosed and claimed herein are within the scope and spirit of the present invention.

DETAILED DESCRIPTION OF THE DRAWINGS

The following drawings and schematics emphasize the logic. A variety of electronic microchip components may be utilized to accomplish similar functions and are not referenced. Support functions such as power supply and control hardware are similarly omitted since their use is common through the industry.

Figure 1:
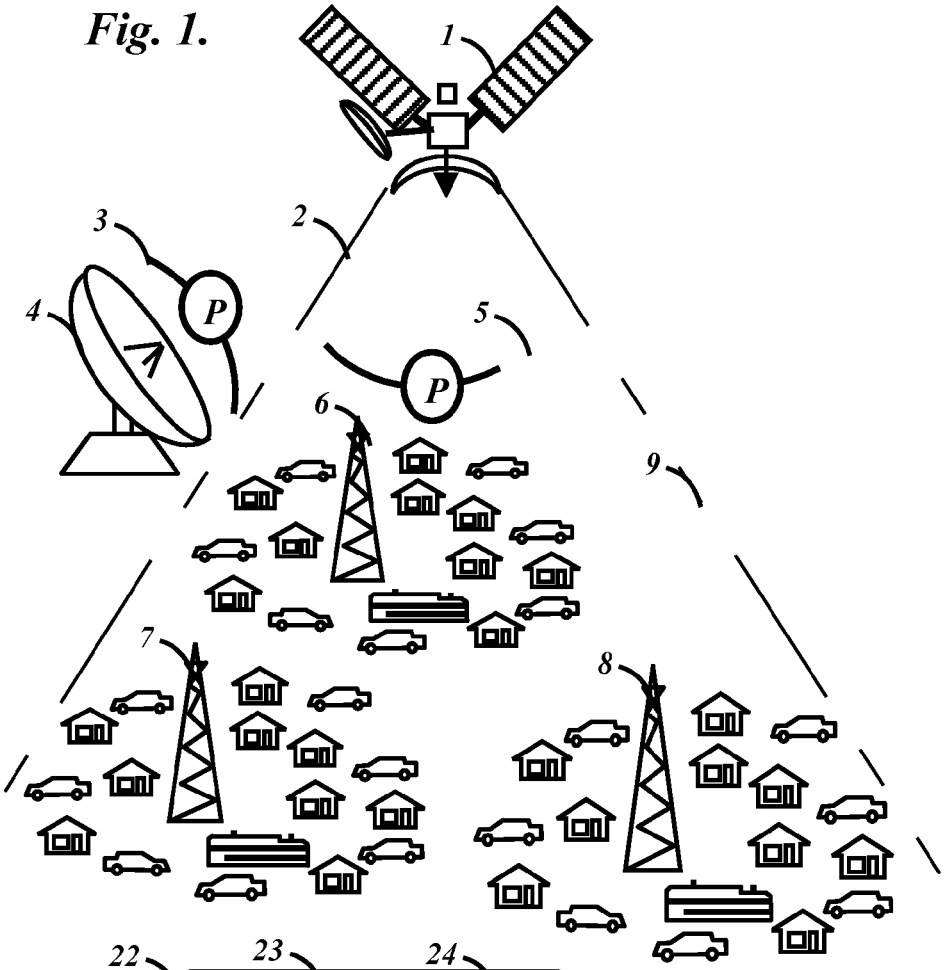
FIG. 1 is a schematic of a satellite digital audio broadcasting system after the teachings of the present invention.

In FIG. 1 a ground based uplink antennae 4 is shown transmitting digital audio media drawn as a wavefront 3 that contains an instruction for polling P directed toward a orbiting satellite 1. The satellite 1 in turn is shown broadcasting DAB services spanning an area defined from line 2 to lines 9 covering three local areas shown grouped around local monitoring towers 6, 7, and 8. Within the satellite's DAB signal wave 5 a polling signal P is shown. Each local area is shown comprising mobile DAB client receivers represented by automobiles and fixed DAB client receivers represented by houses and factories, whether in homes, commercial establishments, or institutions. The polling signal P is received simultaneously by all three LMS towers 6, 7, and 8 within the satellite transmission 5.

Figure 2:
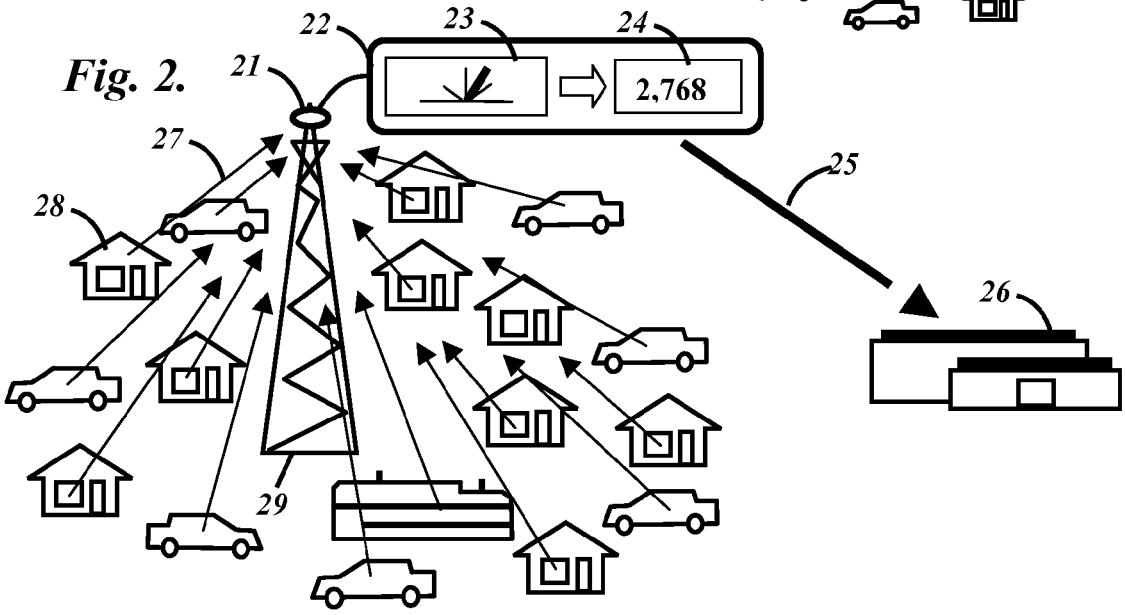
FIG. 2 is a schematic of a local monitoring station (LMS).

In FIG. 2 the arrows indicate the response signals generated by DAB client responders. For example fixed client radio at a house 28 generates a chirp that is propagated in all directions with a portion of that signal indicated by arrow 27 radiating to a LMS 21 mounted on a tower 29. Both fixed and mobile DAB client responders are shown. Their independent signals which are of a low signal strength are received by a LMS 21 which is shown to be located at the top of a ground based tower 29 mainly central to a local area. The electronic functioning of the LMS is shown in schematic 22 where the total signal strength at the LMS is measured as shown schematically by an analog signal strength meter 23. This signal strength measurement 23 is used to calculate the number of client radios responding 24 based upon the known signal strength of one chirp response. The LMS communicates that calculated total estimate by wired or wireless means 25 to a digital collection site 26.

Figure 3:
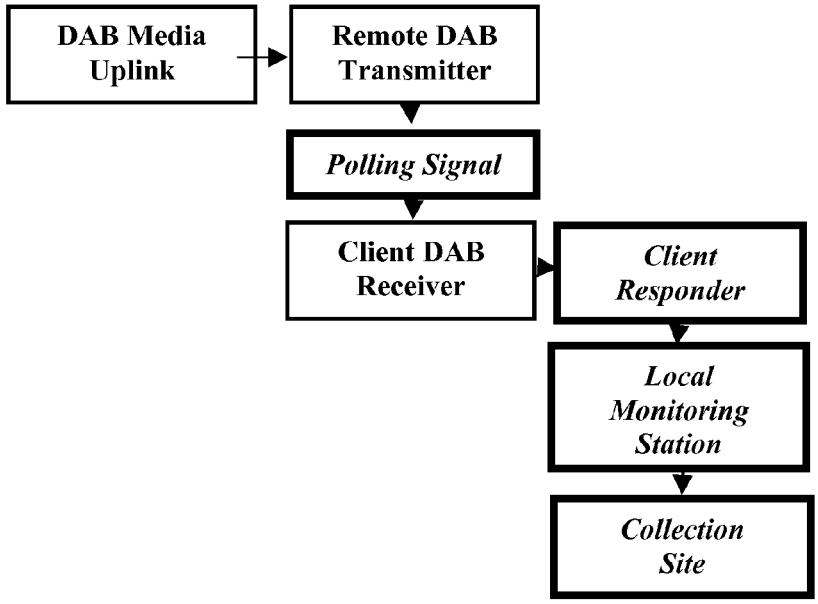
FIG. 3 is a flow diagram of the components of the present invention and how they integrate with a DAB system.

In FIG. 3 are shown in thin line box borders the existing components of a DAB transmission system, including the DAB media uplink, remote DAB transmitter, and client DAB receiver. To these components, under the teaching of the present invention, are added a polling signal within the DAB transmission of the remote DAB transmitter. Also added are the client responder to the client DAB receiver. These additional components are indicated by thick line box borders. The client responder has a relationship with the LMS through its broadcast of a low signal strength chirp, which with other chirps from other client responders, is measured for signal strength and reception sequence by the local monitoring station. The LMS then transmits this data in either its raw form or in its analyzed form as a receiver count to a data collection site. The data collection site is a reception point for data streams from multiple LMSs. It may be an independent site or reside in a satellite broadcasters corporate marketing or accounts payable department.

Figure 4:
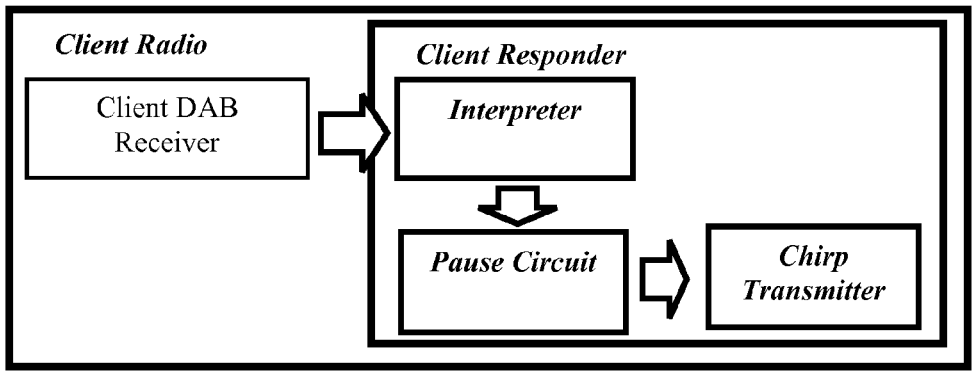
FIG. 4 is a block schematic of the client DAB radio and the client responder.

In FIG. 4 one embodiment of the client responder is shown as an integral component added to the internal circuitry of a client DAB receiver. The client responder comprises three elements: a detector, a pause interval circuit, and a chirp transmitter. The detector provides for the detection and clocking of the digital audio broadcast (DAB) bit rate, and for the detection and interpretation of digital information within the received polling signal, including timing instructions, from the remote DAB transmitter either before or after decoding and demodulation processes by the client receiver. The reception of a polling signal including timing instructions received by the detector alerts a pause interval circuit which retards and postpones any alert and timing instructions for a preselected retardation interval. The pause interval circuit is disposed to pause on the basis of the timing instruction and the DAB bit rate. Then in turn the pause interval circuit issues an alert, coupled with timing instructions, that triggers the transmission of a chirp response from the chirp transmitter if queries within the polling signal have been satisfied.

A key element of the current invention is the client radio that comprises two major units, the client receiver and the client responder. This invention teaches that the client responder comprises hardware and firmware that interconnects to a DAB client receiver in two fundamental functional ways between discrete electronic components without undue complication that are appreciated by one of ordinary skill in the art.

In order to adequately describe this interrelationship, it must be understood that there are a variety of current and emerging client receivers that must be considered and reduced to a typical unit to expedite the teaching. There are a variety of electronic media formats for digital audio broadcasting including Digital Radio Mondaile (DRM), in band on channel (IBOC) and others. There are also DAB receiver radio sets specifically for either desktop or mobile use in vehicles. In addition there are a variety of retrofit hardware schemes such as a conversion kit that fits into the CD opening of a CD-ROM player using the existing amplifier and speakers. There are also schemes that retrofit an analog radio that utilize the existing antenna, amplifier, and speakers. For these reasons it is necessary to use a typical block diagram for a receiver to describe the electronic interrelationship between a typical DAB client receiver and the client responder. Another complication is that a client receiver may be equipped with one or more antennas that are each optimized for FM, AM, DAB, or other media. For the purposes of this teaching the antenna will be considered to be capable of both receiving DAB and transmitting a responsive chirp.

Figure 5:
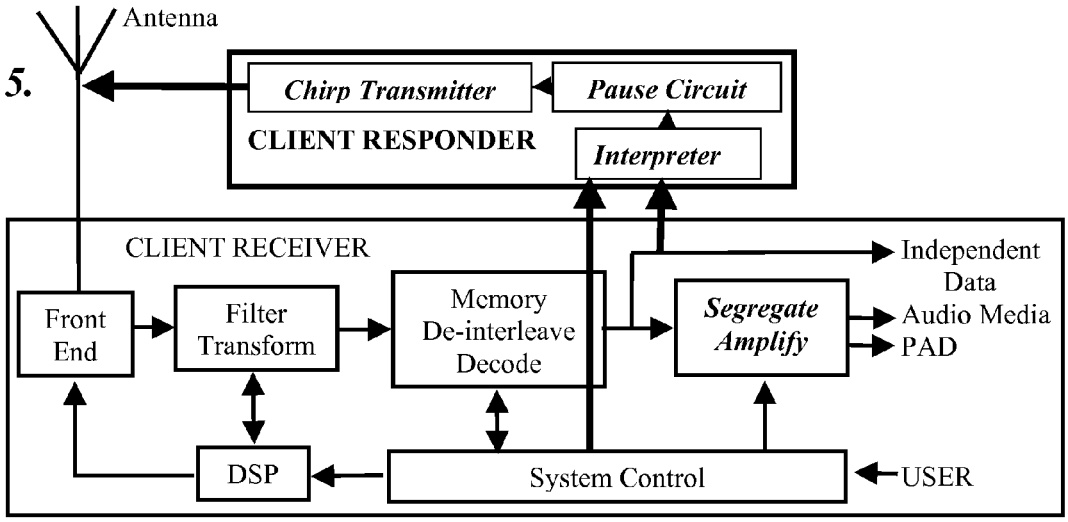
FIG. 5 is a block diagram of a client satellite radio showing the two principal components and their interconnection.

FIG. 5 shows the components of a typical client receiver functionally segregated into blocks within a thin line border. The DAB signal as transmitted is received by the antenna. The antenna is connected to the front end of the receiver. The front end amplifies the signal and communicates it to the filter and transform block. Portions of the filtered and transformed signal are stored in memory and then de-interleaved and decoded into a re-sequenced digital audio media. In the segregate and amplify block the audio media is separated from the program auxiliary data and the audio media is amplified.

The client receiver is activated by the user whose inputs to the system control select the media channel for audio delivery. This user preference is then communicated to the digital signal processor as well as all other blocks of the system which perform their support functions in channel selection.

The outputs of a typical client receiver are audio media, program auxiliary data (PAD), and independent data as are shown to the right of the client receiver block. The user input to the system control is shown at the lower right of the client receiver block.

The client responder is shown as the upper block of FIG. 5 within a thick line border as possessing an interpreter, a pause circuit, and a chip transmitter. The chip transmitter is connected to the antennae for RF transmission of its chirp. A polling signal is received by the antennae as a portion of the coded and modulated and interleaved DAB signal. This signal flows to the front end, is filtered and transformed, is decoded and re-sequenced, and emerges as a portion of the independent data stream. The diagram shows that the independent data stream is connected to the interpreter of the client responder, which monitors this independent data stream for the polling signal and the queries that are imbedded within the data stream. The second connection between the client receiver and the client responder is from system control to the interpreter. Because of the user preferences that are input into the system control, this interconnection between system control and the interpreter of the client responder makes it possible for the interpreter to register what audio media channel is activated, the volume level, and any segregated preferences within the independent data stream. When the interpreter receives a polling signal that includes queries that can be interpreted with a positive response, it relays this to the pause circuit and thence to the chip transmitter, and thence to the antennae for simultaneous response with other client radios.

Figure 6:
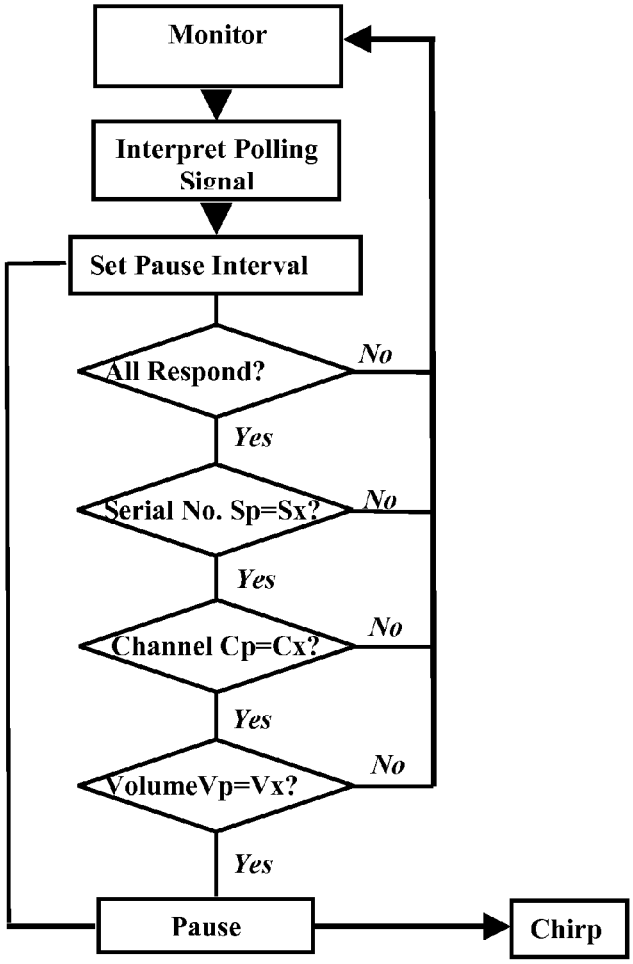
FIG. 6 is a flow chart of the logic within the interpreter component of the client responder.

FIG. 6 shows that any negative answer to one of the queries obviates any chirp response by a client radio. As is common in digital programming, each query is processed as a comparison against the status within a client radio. It will be understood by one skilled in the art that each query may be as digitally compact as a single digit. It will also be recognized by one skilled in the art that any instructions in the query may have a neutral value that passes the decision point with a yes despite the status of the client radio.

The logic progression of the polling signal within the interpreter begins with the interpreter's monitoring of the independent data stream of the client receiver as shown in the upper block. In all cases, the interpreter segregates the pause interval from the interpreted polling signal and instructs the pause circuit with the pause interval data. Next, the logic flows to a decision point in the block diagram where a query may or may not request that all receivers respond. If the query is for an all response signal, then the first logic branches to the "Yes" below the decision diamond. If the response is not for all receivers, then the decision sequence flows back to the monitoring block to await the next polling signal. Following the "Yes" branch the logic sequence flows to the next decision point where the polling signal may request for the response of only client radios possessing an assigned serial number within a specific range (Sp). Again a match with the serial number of client radio X (Sx) moves the logic to the next branch and a non-match moves the logic back to the monitoring block. In like manner the next branch compares the incoming query for a specific channel selection active in the client radio's system control block. Thus, the polling signal query specifies a particular channel such as (Cp). If Cp equals Cx the active channel selected by the user, then a "Yes" results. At the next branch the query includes a request for an audible volume setting (Vp) within the system control of the client receiver (Vx). A "Yes" response results and a "No" response initiates a reset condition to the interpreter which begins again to monitor the incoming media for a poling signal.

Figure 7:
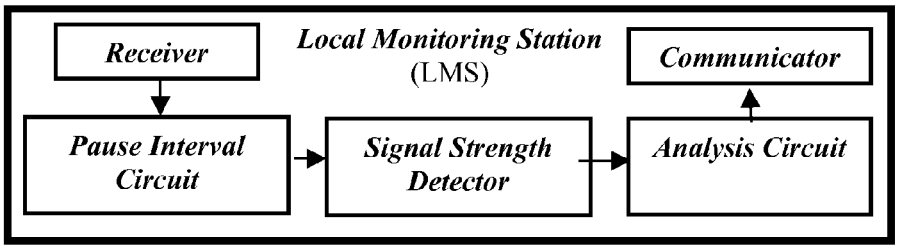
FIG. 7 is a block diagram of the LMS.

In FIG. 7 one embodiment of the local monitoring station (LMS) is shown to comprise five components: a receiver, a pause interval circuit, a signal strength detector, an analysis circuit, and a communicator. The receiver is capable of receiving polling signals from the remote transmitter that alert it to begin monitoring after a specific pause interval. Otherwise the LMS is dormant. When alerted by the pause interval circuit, the signal strength detector measures the signal strength for each interval of time. The likely interval of time for this measurement would be an integer fraction of the typical DAB broadcasting bit rate of 128 K-bit/sec or other rate. This signal strength per unit of time is sent to an analysis circuit for the generation of a count of the number of client DAB radios transmitting a chirp within the specific local area covered by the LMS. This data is transferred the communicator which transmits the data to the collection site.

Figure 8:
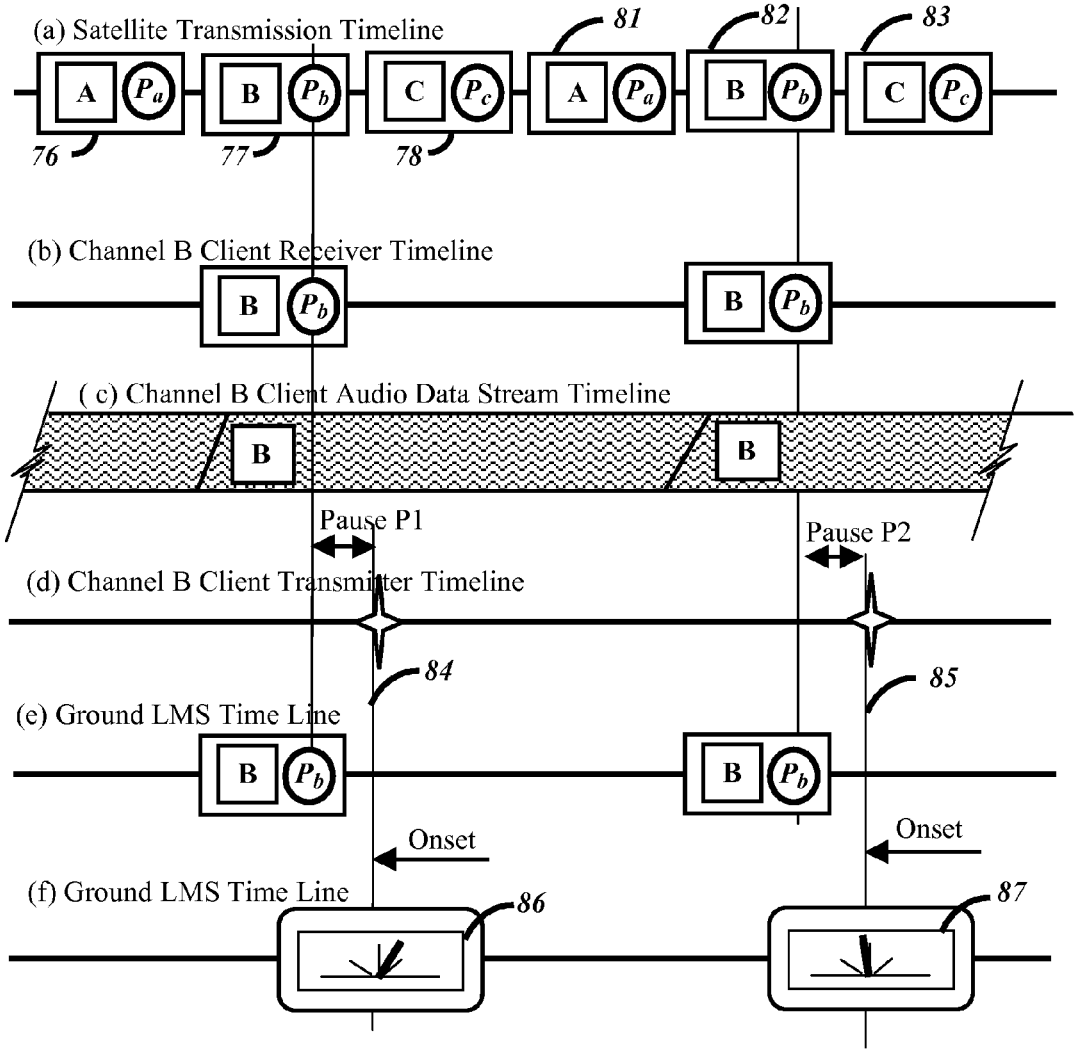
FIG. 8 is a graph of signal strength and number of client radios per group versus time.

FIG. 8 shows the components of a satellite transmission as six simultaneous timelines a through f. Timeline 8*a* simplifies the complexities of interspersed channels and modulation of DAB into a series of packets broadcast sequentially for simplification of the explanation of the current invention. Although a DAB may be comprised of 100 channels, for illustration purposes, only 3 channels are shown: channels A, B, and C. The packets are separated by a space to indicate a null signal from the remote area transmitter during this time interval. Within each channel packet such as packet A 81 is shown the DAB compressed media for channel A and a polling signal exclusive to that channel Pa. The packets for channel B 82 and channel C 83 are also shown as examples in the digital data stream. In FIG. 8*b*, a client receiver is tuned to receive channel B. And in the packet of channel B, the client receiver processes and extracts the DAB media data and the polling signal exclusive to channel B. In FIG. 8*c*, the B client audio data stream is shown as a continuous expansion of the audio media received within the packet. In FIG. 6*d*, this client transmitter that is tuned to channel B emits a chirp after a preset delay. Note that each polling signal may provide a variation in the Pause. In this case the first pause P1 may vary from the second pause P2. The onset of the pauses P1 and P2 is indicated by the onset lines 84 and 85. In FIG. 8*e*, the ground station LMS has also received the B packet and is alerted by the B packet polling signal. The ground station LMS ignores the media within the DAB, and after the preset delay, begins its monitoring activity at onset points 84 and 85. This monitoring activity is shown by the analog meters 86 and 87 in FIG. 6*f*. The second meter 87 shows a different and lower needle reading of signal strength than the first meter 86, indicating that fewer chirps have been received.

Figures 9, 10:
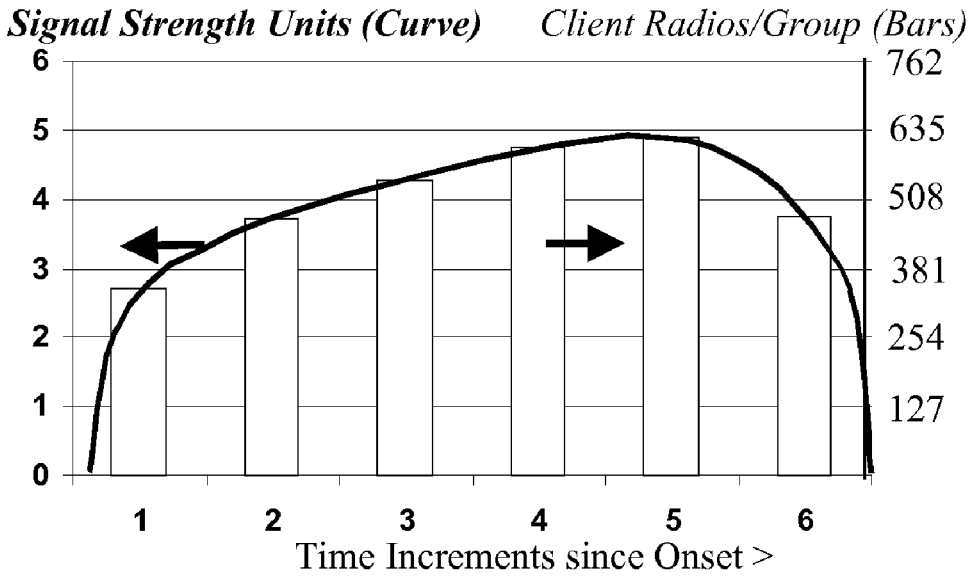
FIG. 9 represents a curve and bar diagram showing the results of the current invention.
FIG. 10 is a table of LMS data leading to a total count of client responders.

The graph of FIG. 9 shows the curve that results from the measurement of signal strength by a LMS over six time increments after onset for a widely dispersed area of client radios. Onset refers to both the onset of measurement by the LMS and the onset of a multitude of simultaneous RF chirp transmissions. This signal strength curve is the measurement by a single signal strength detector instrument of a multitude of chirps received over a duration of six time increments after onset at a LMS. The simplified values of the signal strength are shown on the left-hand scale and range from 1 to 6.

In can be seen from the signal strength curve in FIG. 9 that the area under the curve is a representation of the number of chirps received. In practical terms it is not an exact representation because some chirps are too isolated within buildings or under structures. Additionally, it is not a direct representation because the later the reception measure due to distance from the LMS, the more chirps were required to produce a unit of signal strength within the curve. It will be recognized by one skilled in the art that electronic integrators are available to evaluate the area under the curve for these time based variables. However, to fully explain the nature of the solution offered by this current invention, a more approximate method employs dividing the duration into increments and estimating the number of chirps as a group within each increment. Depending on the bit rate or other internal electronic clock speed, the time increment determined for to delineate the groups may vary. An ideal time increment for division into groups would be the exact duration of a chirp since each chirp would only contribute to one group. However, partial signal strength contribution can be taken into account in the estimating process.

Beyond the signal strength curve discussed above FIG. 9 also contains a bar graph representing the calculation of the number of client radios based on the signal strength measurements. Six bars are shown, one for each group of chirps designated for within each time increment of delayed reception by an LMS. This calculation of the number of client radios is based on (1) the exact known equal value of each of the chirps, and (2) the fact that the signal strength of the chirp varies as square of the distance between the transmitter and receiver, and (3) the measured retardation of reception or time since onset. The number of client radios per group is shown on the right hand scale. For each time increment the electronic mechanisms within the LMS make a precise capture of the value of the signal strength in the center of the time increment. This is illustrated by the center of the top of each bar intersecting the curve at the center of the time interval. The LMS may be located in any local orientation to the local area. For discussion it is assumed to be somewhat centered within its local area. The resulting topology of a centered LMS dictates that the majority of the client receivers are at the periphery of the local area. Any individual chirp more than a fraction of a mile away from the LMS is not detected due to the low signal strength of each individual chirp. In concert large groups of chirps produce a measurable signal strength. Yet the reception of the chirps are strung out due to distance which is a retardation that can be measured in time since onset. Thus the total signal strength as received at a LMS is graphed as a curve versus time since onset. Those client receivers that are in close proximity to the LMS are shown to arrive nearly instantly. Those further away, even though their numbers may be many multiples of those received nearly instantaneously, must rely on being added as a contributing component of other chirps simultaneously emitted. The summation of these six bar graph values is representative of a total count for the number of client receivers polled for either tuning to a specific channel or other polling query.

FIG. 10 is a numerical representation of the LMS internal process that leads to a total count of responders within a local area. The table is based on a preselected preset signal strength for one client radio chirp of 75 millionths of a watt at a distance of one mile.

In column 1 the detector in the LMS, having been alerted by the LMS receiver to a polling signal and its pause instruction, begins a measurement of signal strength in terms of voltage for a set increment of time between measurements. Such increments may be pure time measurements in units of approximately two millionths of a second as shown in column 2 in the table. In this case the time increments are adopted from a fraction of the DAB bit-rate of 128 k-bits per second. These time increments represent the cumulative measured reception delay since signal strength monitoring began. For this table the duration on one chirp is equal to the time segment increment in order to illustrate the principle of the current invention. It will be known to one skilled in the art that a chirp with a longer duration than the timed increment in column 2 will effect the measured signal strength as it is depicted in column 1. In this case of a longer duration chirp a more elaborate numerical manipulation will be required to extract and derive the measured signal strength attributable to one time increment.

In column 3 the distance is calculated based on column 2, the measured reception delay. In column 4 is represented the contributed weight of one chirp at varying distances. The signal strength for one client radio chirp is calculated from the distance that the group of client radios is away from the LMS. The basis for this calculation is the known preselected signal strength of all chirps at a known distance since the signal strength decreases as the square of the distance between transmitter and receiver. Obviously, the calculations of column 2 and 3 can be merged and done in one operation within the software or firmware of the LMS.

Column 5 represents the calculation of the number of client radios responding for each increment of delay since onset. The numbers in column 5 are the result of column 1 divided by column 4. The last number in column 5 is the sum of the other numbers in the column and represents a count of the total number of responders (3985) to the polling signal within the LMS.

The invention claimed is:

1. A client radio comprising:

a client DAB receiver, the DAB receiver configured to receive a polling signal from a remote DAB transmitter, further the DAB receiver connected by internal circuitry to;

a client responder, the client responder to provide for detection and clocking of a digital audio broadcast (DAB) bit rate, and further to provide interpretation of digital information within the polling signal received from the from the remote DAB transmitter, and further is configured to receive a timing instruction coupled with a paused alert, the paused alert is configured for on a basis of the timing instruction and the DAB bit rate, further the client responder comprises:

a chirp transmitter, the chirp transmitter configured to provide for issuance a predetermined RF signal strength chirp; further the client radio chirp issuance is configured for synchronicity with a multiplicity of other equivalent client radio chirp issuances within a local DAB area, further the synchronicity disposition is provided for by the client radio synchronization response utilization of the digital audio broadcast (DAB) transmission bit rate;

whereby, instance of alert communication issuance to the chirp transmitter is determined by utilization of the digital audio broadcast (DAB) embedded timing instruction.

2. A multicast audience measurement system comprising:

a remote transmission source selected to provide digital audio multicasts and synchronizing polling signals for at least one digital audio broadcast (DAB) local area; the digital audio multicasts and the synchronizing polling signals received by;

a multiplicity of the client radios, each client radio comprising a receiver and chirp transmitter, further each receiver and chirp transmitter configured to receive and process DAB signals for consumer selected multicast audio media delivery, and further each receiver and a chirp transmitter configured to receive, process, and issue the synchronizing polling signals to provide for responsive RF signal transmission chirps for each client radio, at a known reception signal strength ($S_N$), in simultaneous concert with other said client radio receiver and chirp transmitters within the DAB local area, further the responsive RF signal transmission chirps are received by;

a local monitoring station within the at least one DAB local area, the local monitoring station independent and distinct from all transmission-reception DAB communication pathways, further the local monitoring station comprises:

a communicator, the communicator in continuous data transfer of client counts related to polling signal instruction communicated with a data collection site;

whereby, the local monitoring station is selected to receive, process, and measure indicated signal strength of the short RF transmission response chirp;

further the local monitoring station selected to detect and measure the total signal strength of the received multiplicity of RF signals ($S_T$), whereby, a statistical representation of the total number of the client radio receiver and chirp transmitters ($N_R$) is determined by the equation:

$$N_R = S_T / S_N$$

3. The multicast audience measurement system of claim 2, wherein the synchronizing polling signal is configured to provide for a multiplicity of instructions selected for measurement of at least one said client DAB receiver.

4. The multicast audience measurement system of claim 2, wherein the RF transmission response chirp is selected for issuance after a preset interval.

5. The multicast audience measurement system of claim 2, wherein digital audio broadcast (DAB) signal wavelength is synchronously configured with RF transmission response chirp wavelength.

6. The multicast audience measurement system of claim 2, wherein digital audio broadcast (DAB) signal wavelength is non-synchronously configured with RF transmission response chirp wavelength.

7. The multicast audience measurement system of claim 2, wherein the measurement system comprises at least one local DAB multicast ground repeater to provide for transmission service.

8. The multicast audience measurement system of claim 2, wherein a local monitoring station (LMS) receiver comprises at least one directional antenna, said at least one directional antenna selected to detect the signal strength of RF transmission response chirps.

9. The multicast audience measurement system of claim 2, wherein the local monitoring station communicator in communication means with the data collection site chosen from the means of land line phone connection, cellular phone connection, internet communication, dedicated network communication, and wireless transmission.

10. The multicast audience measurement system of claim 2, further comprising at least one digital data receiver, the at least one digital data receiver in electronic communication with the local monitoring station, further the at least one digital data receiver in electronic communication with the DAB satellite transmitter, whereby changes in user preferences derived from subsequent counts of statistically relevant samples of chirp responses for a particular channel provide for the prioritization of the selection of digital data media, imbedded in a DAB data channel for reception by the at least one digital data receiver.

11. The multicast audience measurement system of claim 3, wherein the multiplicity of instructions is selected to elicit a response based upon consumer media channel selection at time of the response.

12. A method of time-interval group calculating for the total number of a multiplicity of simultaneously generated, individually undetectable short RF transmission chirps, the RF transmission chirps configured with a known signal strength at a known distance and received by the local monitoring station, further the method comprising:

preselecting a synchronising onset time instance for all groups;

preselecting a single incremental time measure for the separation of all groups after onset;

beginning the first signal strength measurement for each group after onset;

taking subsequent sequential measurements, for each group, of peak signal strength during each time interval attributable to each time-interval group;

mathematically determining, for each group, cumulative time passage since onset;

calculating distance that each time interval group is distant from the local monitoring station by utilizing the cumulative time passage for each group and by utilizing speed of radio transmission;

mathematically determining an estimate of the received signal strength utilizing the distances for each group and utilizing the relationship that signal strength decreases as the square of the distance;

calculating an estimate of each groups' received signal strength utilizing the cumulative time passage for each group since onset;

calculating the number of chirps for each group by dividing the peak signal strength by the received signal strength;

calculating the total number of chirps in all groups by adding the calculated number of chirps in all groups together.

* * * * *